US011453471B1

(12) United States Patent
Yamaguchi et al.

(10) Patent No.: US 11,453,471 B1
(45) Date of Patent: Sep. 27, 2022

(54) VESSEL STEERING SYSTEM AND VESSEL STEERING METHOD

(71) Applicant: YAMAHA HATSUDOKI KABUSHIKI KAISHA, Iwata (JP)

(72) Inventors: Kohei Yamaguchi, Shizuoka (JP); Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 350 days.

(21) Appl. No.: 16/827,841

(22) Filed: Mar. 24, 2020

Related U.S. Application Data

(60) Provisional application No. 62/823,109, filed on Mar. 25, 2019.

(51) Int. Cl.
*B60L 15/00* (2006.01)
*B63H 21/21* (2006.01)

(52) U.S. Cl.
CPC ..... *B63H 21/21* (2013.01); *B63H 2021/216* (2013.01)

(58) Field of Classification Search
CPC ..... B63H 21/21; B63H 21/213; B63H 25/02; B63H 25/42
See application file for complete search history.

(56) References Cited

U.S. PATENT DOCUMENTS

| | | | | |
|---|---|---|---|---|
| 11,370,520 | B1 * | 6/2022 | Yamaguchi | G05D 1/0875 |
| 2017/0144740 | A1 | 5/2017 | Ito et al. | |
| 2018/0134353 | A1 * | 5/2018 | Suzuki | B63H 21/21 |
| 2021/0221485 | A1 * | 7/2021 | Grunewald Mayer | G08G 3/02 |
| 2022/0177104 | A1 * | 6/2022 | Sakurada | B63H 21/213 |

FOREIGN PATENT DOCUMENTS

JP 2017-094945 A 6/2017

* cited by examiner

*Primary Examiner* — John Kwon
(74) *Attorney, Agent, or Firm* — Keating and Bennett, LLP

(57) ABSTRACT

A propulsive force suitable to hold a vessel at a target position is determined, by a controller that controls a propulsion device in a fixed point holding mode to hold the position of the vessel. The controller acquires a parameter including the position of the vessel or a vessel speed. The controller determines a target value for the parameter. The controller determines a demand output of the propulsion device within a predetermined upper limit value or less by feedback control according to a deviation between the parameter and the target value. The controller increases the upper limit value when the demand output of the propulsion device is greater than or equal to a first threshold. The first threshold is defined by a predetermined ratio with respect to the upper limit value.

16 Claims, 10 Drawing Sheets

(A)

(B)

VESSEL STEERING SYSTEM AND VESSEL STEERING METHOD

CROSS REFERENCE TO RELATED APPLICATIONS

This application claims the benefit of priority to U.S. Patent Application No. 62/823,109 filed on Mar. 25, 2019. The entire contents of this application are hereby incorporated herein by reference.

BACKGROUND OF THE INVENTION

1. Field of the Invention

The present invention relates to a vessel steering system and method.

2. Description of the Related Art

A vessel steering system that controls a propulsion device of a vessel in a fixed point holding mode that holds a position of the vessel is known. For example, in a vessel steering system disclosed in Japanese Laid-open Patent Publication No. 2017-094945, a vessel speed is detected. Then, a controller of the vessel steering system controls a propulsive force of the propulsion device by feedback control so that the vessel speed becomes zero. As a result, the vessel is held at the target position.

In the fixed point holding mode, if the propulsion device is controlled with an excessively large propulsive force, it is difficult to finely adjust the position of the vessel. Therefore, it is not easy to hold the vessel at the target position. On the other hand, when the propulsive force is excessively small, it is difficult to counter a disturbance such as wind or water flow, and it is difficult to approach the target position. Further, the propulsive force suitable for holding the vessel at the target position varies depending on conditions such as the weather or the type of vessel, and is not constant. Therefore, it is not easy to determine an appropriate propulsive force for holding the vessel at the target position.

SUMMARY OF THE INVENTION

Preferred embodiments of the present invention provide an appropriate propulsive force to hold a vessel at a target position.

A vessel steering system according to a preferred embodiment of the present invention includes a propulsion device and a controller. The controller controls the propulsion device in a fixed point holding mode to hold a position of the vessel. The controller acquires a parameter including a position of the vessel or a vessel speed. The controller determines a target value for the parameter. The controller determines a demand output of the propulsion device within a range that is equal to or less than a predetermined upper limit value by feedback control according to a deviation between the parameter and the target value. The controller increases the predetermined upper limit value when the demand output of the propulsion device is greater than or equal to a first threshold. The first threshold is defined by a predetermined ratio with respect to the upper limit value.

A method according to another preferred embodiment of the present invention includes executing a method by a controller to steer a vessel including a propulsion device. The method includes receiving a command signal in a fixed point holding mode to hold a position of the vessel, acquiring a parameter including the position of the vessel or a vessel speed, determining a target value for the parameter, determining a demand output of the propulsion device within a range that is equal to or less than a predetermined upper limit value by feedback control according to a deviation between the parameter and the target value, and increasing the predetermined upper limit value when the demand output of the propulsion device is greater than or equal to a first threshold. The first threshold is defined by a predetermined ratio with respect to the upper limit value.

According to preferred embodiments of the present invention, it is possible to determine an appropriate propulsive force to hold a vessel at a target position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
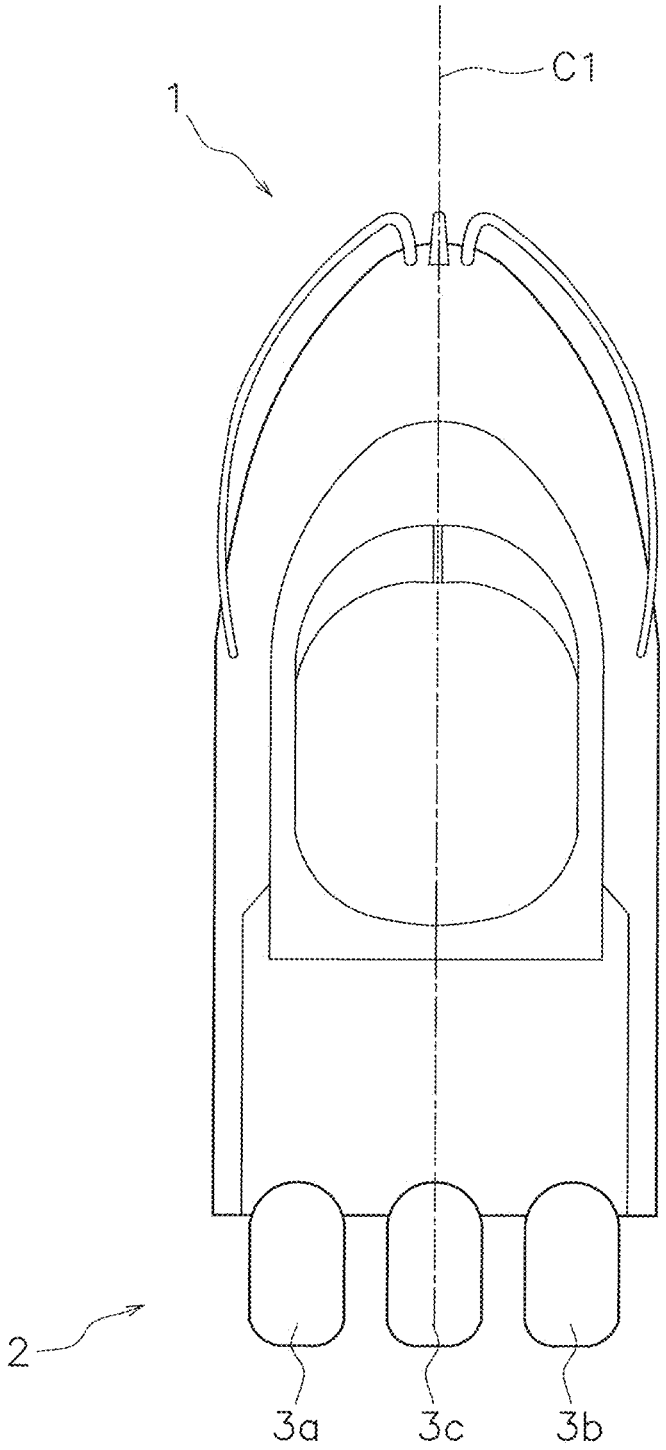
FIG. 1 is a top view showing a vessel according to a preferred embodiment of the present invention.

Hereinafter, preferred embodiments will be described with reference to the drawings. FIG. 1 is a top view showing a vessel 1 according to a preferred embodiment of the present invention. The vessel 1 includes a vessel steering system 2 according to a preferred embodiment of the present invention. As illustrated in FIG. 1, the vessel steering system 2 includes a plurality of propulsion devices 3*a* to 3*c*. The propulsion devices 3*a* to 3*c* are outboard motors, for example. Specifically, the vessel 1 includes a left propulsion device 3*a*, a right propulsion device 3*b*, and a central propulsion device 3*c*. In the following description, the front, rear, left, right, up, and down directions mean the front, rear, left, right, up, and down directions of the vessel 1.

The propulsion devices 3*a* to 3*c* are attached to the stern of the vessel 1. The propulsion devices 3*a* to 3*c* are arranged side by side in the width direction of the vessel 1. Specifically, the left propulsion device 3*a* is disposed on the left side of the center line C1 extending in the longitudinal direction of the vessel 1. The right propulsion device 3*b* is disposed to the right of the center line C1. The central propulsion device 3*c* is disposed between the left propulsion device 3*a* and the right propulsion device 3*b*. Each of the propulsion devices 3*a* to 3*c* generates a propulsive force that propels the vessel 1.

Figure 2:
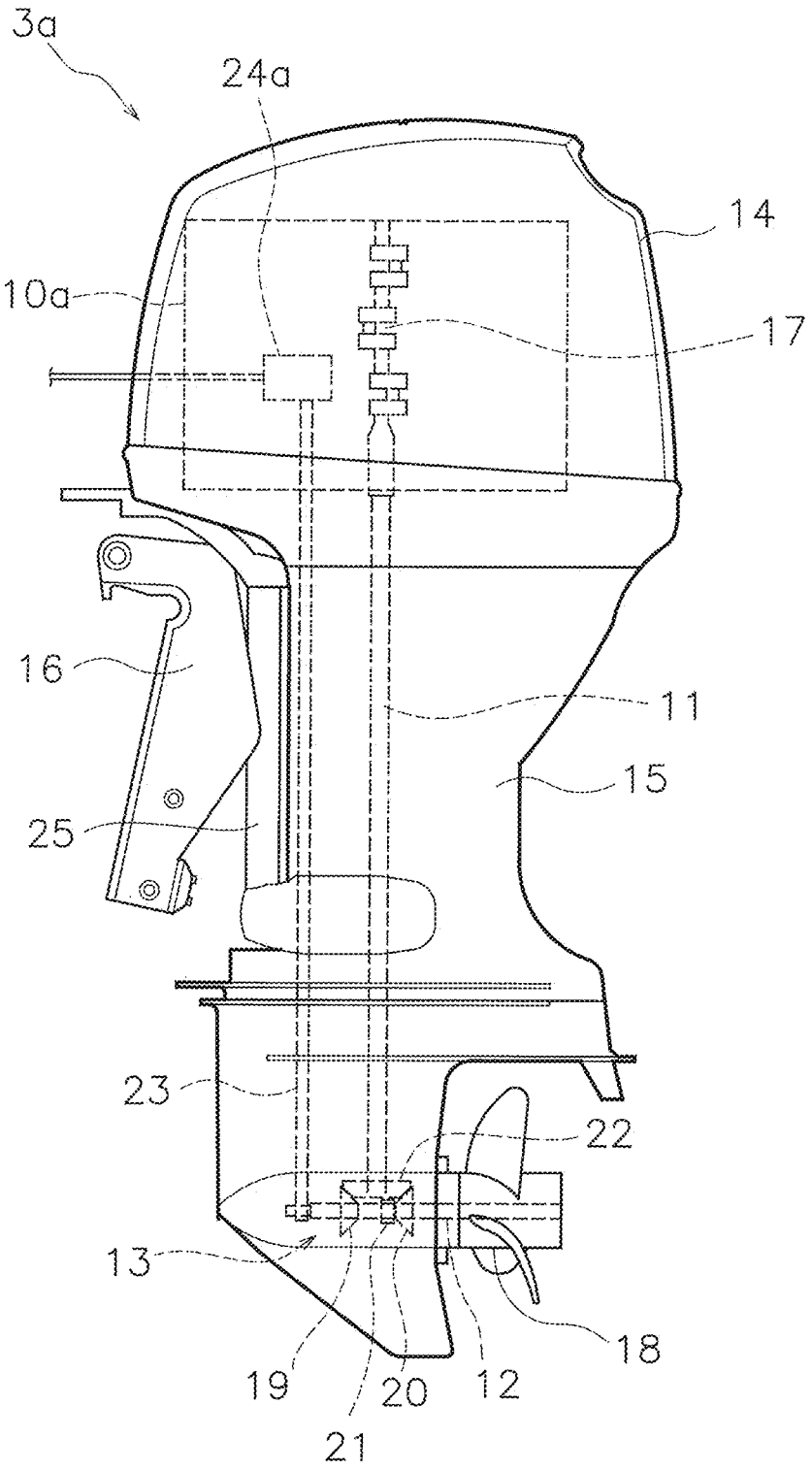
FIG. 2 is a side view of a left propulsion device.

FIG. 2 is a side view of the left propulsion device 3*a*. The left propulsion device 3*a* includes an engine 10*a*, a drive shaft 11, a propeller shaft 12, a shift mechanism 13, an engine cowl 14, a housing 15, and a bracket 16.

The engine 10*a* generates a propulsive force that propels the vessel 1. The engine 10*a* is disposed in the engine cowl 14. The engine 10*a* includes a crankshaft 17. The crankshaft 17 extends in the vertical direction. The drive shaft 11 is connected to the crankshaft 17. The drive shaft 11 extends downward from the engine 10*a*. The propeller shaft 12 extends in a direction intersecting with the drive shaft 11. The propeller shaft 12 extends in the longitudinal direction. The propeller shaft 12 is connected to the drive shaft 11 via the shift mechanism 13. A propeller 18 is connected to the propeller shaft 12.

The housing 15 is disposed below the engine cowl 14. The drive shaft 11, the propeller shaft 12, and the shift mechanism 13 are disposed in the housing 15. The shift mechanism 13 switches the rotational direction of the power transmitted from the drive shaft 11 to the propeller shaft 12. The shift mechanism 13 includes a forward gear 19, a reverse gear 20, and a clutch 21. The forward gear 19 and the reverse gear 20 mesh with the bevel gear 22. The bevel gear 22 is attached to the drive shaft 11. The clutch 21 selectively engages the forward gear 19 and the reverse gear 20 with the propeller shaft 12. The clutch 21 is able to move to a forward position, a reverse position, and a neutral position.

The clutch 21 engages the forward gear 19 and the propeller shaft 12 at the forward position. Accordingly, the rotation of the drive shaft 11 is transmitted to the propeller shaft 12 so as to rotate the propeller shaft 12 in the forward direction. The clutch 21 engages the reverse gear 20 and the propeller shaft 12 at the reverse position. Thus, the rotation of the drive shaft 11 is transmitted to the propeller shaft 12 so as to rotate the propeller shaft 12 in the reverse direction. When the clutch 21 is in the neutral position, both the forward gear 19 and the reverse gear 20 are released from the propeller shaft 12. Therefore, the rotation of the drive shaft 11 is not transmitted to the propeller shaft 12.

The left propulsion device 3*a* includes a shift member 23 and a shift actuator 24*a*. The shift member 23 is connected to the shift mechanism 13. The shift member 23 is able to operate the shift mechanism 13. Specifically, the shift member 23 is connected to the clutch 21. The shift member 23 is driven by the shift actuator 24*a* to move the clutch 21 to the forward movement position, the reverse movement position, and the neutral position. The shift actuator 24*a* is connected to the shift member 23. The shift actuator 24*a* drives the shift member 23. The shift actuator 24*a* is, for example, an electric motor. The shift actuator 24*a* drives the shift member 23 to switch the clutch 21 to the forward position, the reverse position, and the neutral position.

The bracket 16 attaches the left propulsion device 3*a* to the vessel 1. The left propulsion device 3*a* is detachably fixed to the stern of the vessel 1 through the bracket 16. The bracket 16 includes a steering shaft 25. The left propulsion device 3*a* is supported by the bracket 16 so as to be rotatable about the steering shaft 25.

Figure 3:
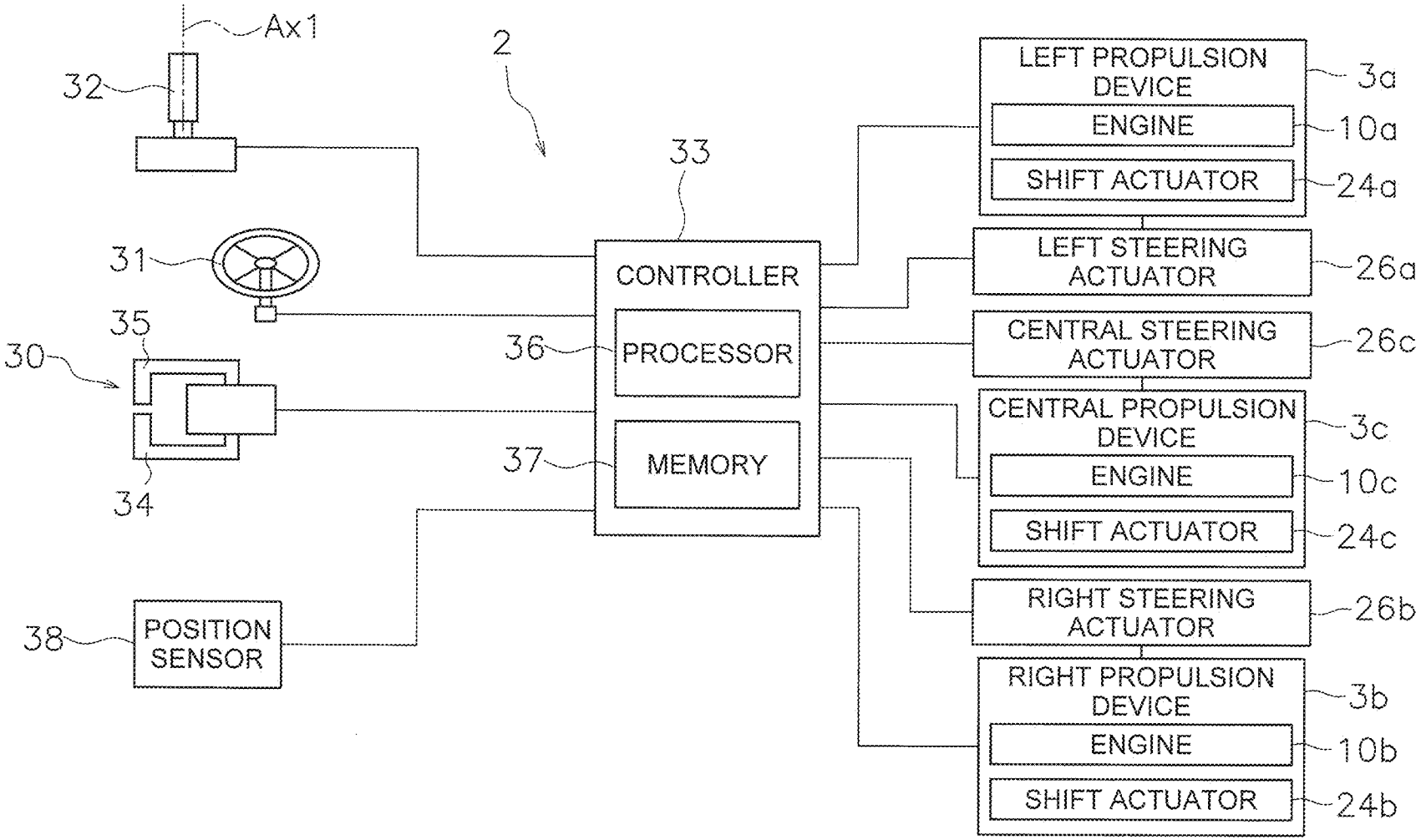
FIG. 3 is a schematic diagram showing a vessel steering system according to a preferred embodiment of the present invention.

FIG. 3 is a schematic diagram showing the configuration of the vessel steering system 2. The right propulsion device 3*b* and the central propulsion device 3*c* have the same configuration as the left propulsion device 3*a*. For example, as illustrated in FIG. 3, the right propulsion device 3*b* includes an engine 10*b* and a shift actuator 24*b*. The engine 10*b* and the shift actuator 24*b* of the right propulsion device 3*b* have the same configuration as the engine 10*a* and the shift actuator 24*a* of the left propulsion device 3*a*, respectively. The central propulsion device 3*c* includes an engine 10*c* and a shift actuator 24*c*. The engine 10*c* and the shift actuator 24*c* of the central propulsion device 3*c* have the same configuration as the engine 10*a* and the shift actuator 24*a* of the left propulsion device 3*a*, respectively.

As illustrated in FIG. 3, the vessel steering system 2 includes a left steering actuator 26*a*, a right steering actuator 26*b*, and a central steering actuator 26*c*. The left steering actuator 26*a* is connected to the left propulsion device 3*a*. The left steering actuator 26*a* rotates the left propulsion device 3*a* around the steering shaft 25. Thus, the left steering actuator 26*a* changes the steering angle of the left propulsion device 3*a*. The left steering actuator 26*a* includes, for example, a hydraulic cylinder. Alternatively, the left steering actuator 26*a* may include an electric cylinder or an electric motor.

The right steering actuator 26*b* is connected to the right propulsion device 3*b*. The right steering actuator 26*b* changes the steering angle of the right propulsion device 3*b*. The central steering actuator 26*c* is connected to the central propulsion device 3*c*. The central steering actuator 26*c* changes the steering angle of the central propulsion device 3*c*. The right steering actuator 26*b* and the central steering actuator 26*c* have the same configuration as the left steering actuator 26*a*.

As illustrated in FIG. 3, the vessel steering system 2 includes a remote control device 30, a steering device 31, a joystick 32, and a controller 33.

The remote control device 30 includes a first operation member 34 and a second operation member 35. The first operation member 34 is operated by a user to control the left propulsion device 3*a*. The first operation member 34 is, for example, a lever. The first operation member 34 is able to be operated to a forward position, a reverse position, and a neutral position. The remote control device 30 transmits a signal indicative of the operation of the first operation member 34 to the controller 33.

The second operation member 35 is operated by a user to control the right propulsion device 3*b*. The second operation member 35 has the same configuration as the first operation member 34. The remote control device 30 transmits a signal indicative of the operation of the first operation member 34 to the controller 33. The remote control device 30 transmits a signal indicative of the operation of the second operation member 35 to the controller 33.

The steering device 31 is, for example, a steering wheel. The steering device 31 is operated by a user in order to control the steering angles of the propulsion devices 3*a* to 3*c*. The steering device 31 is able to be operated to a left turn position, a right turn position, and a neutral position. The steering device 31 transmits a signal indicative of the position of the steering device 31 to the controller 33.

The joystick 32 is tiltable. The joystick 32 is able to be operated in the front-rear, left-right, and diagonal directions therebetween. The joystick 32 is operable 360 degrees in all directions around the rotation axis Ax1 of the joystick 32. The joystick 32 transmits a signal indicative of the position of the joystick 32 to the controller 33. The position of the joystick 32 indicates the tilt direction and the operation amount of the joystick 32. The operation amount of the joystick 32 is a tilt amount of the joystick 32.

The controller 33 includes a processor 36 and a memory 37. The memory 37 includes volatile memory such as a RAM. The memory 37 includes a nonvolatile memory such as a ROM. The controller 33 may include an auxiliary storage device such as a hard disk or an SSD. The memory 37 stores a program and data to control the propulsion devices 3*a* to 3*c* and the steering actuators 26*a* to 26*c*. The processor 36 is, for example, a CPU (Central Processing Unit), and executes processes to control the propulsion devices 3*a* to 3*c* and the steering actuators 26*a* to 26*c* according to the program.

The controller 33 controls the propulsion devices 3*a* to 3*c* and the steering actuators 26*a* to 26*c* based on signals from the steering device 31, the remote control device 30, and the joystick 32. Specifically, the controller 33 controls the direction and magnitude of the propulsive force of the left propulsion device 3*a* according to the position of the first operation member 34. The controller 33 controls the shift actuator 24*a* according to the position of the first operation member 34. As a result, the clutch 21 of the shift mechanism 13 is switched between the forward position, the reverse position, and the neutral position. As a result, the propulsive force of the left propulsion device 3*a* is switched between forward, reverse, and neutral. Further, the controller 33 controls the magnitude of the propulsive force of the left propulsion device 3*a* in accordance with the position of the first operation member 34. The controller 33 controls the magnitude of the propulsive force of the left propulsion device 3*a* by controlling the throttle opening of the engine 10*a*, for example.

The controller 33 controls the direction and magnitude of the propulsive force of the right propulsion device 3*b* according to the position of the second operation member 35. The controller 33 controls the shift actuator 24*b* according to the position of the second operation member 35. Thus, similar to the left propulsion device 3*a*, the propulsive force of the right propulsion device 3*b* is switched between forward, reverse, and neutral. Further, the controller 33 controls the magnitude of the propulsive force of the right propulsion device 3*b* according to the position of the second operation member 35. The controller 33 controls the magnitude of the propulsive force of the right propulsion device 3*b*, for example, by controlling the throttle opening of the engine 10*b*. The controller 33 may control the shift and the propulsive force of the central propulsion device 3*c* according to the operation of the first operation member 34 or the second operation member 35.

The controller 33 controls the steering actuators 26*a* to 26*c* in accordance with the position of the steering device 31. Thus, the steering angles of the propulsion devices 3*a* to 3*c* are controlled. As a result, the turning direction of the vessel 1 is controlled.

The controller 33 controls the propulsion devices 3*a* to 3*c* and the steering actuators 26*a* to 26*c* according to the position of the joystick 32. Specifically, the controller 33 controls the propulsive forces and the steering angles of the propulsion devices 3*a* to 3*c* so that the vessel 1 translates in a direction corresponding to the tilt direction of the joystick 32. Hereinafter, the vessel steering control of the vessel 1 by the operation of the joystick 32 will be described in detail.

Figure 4:
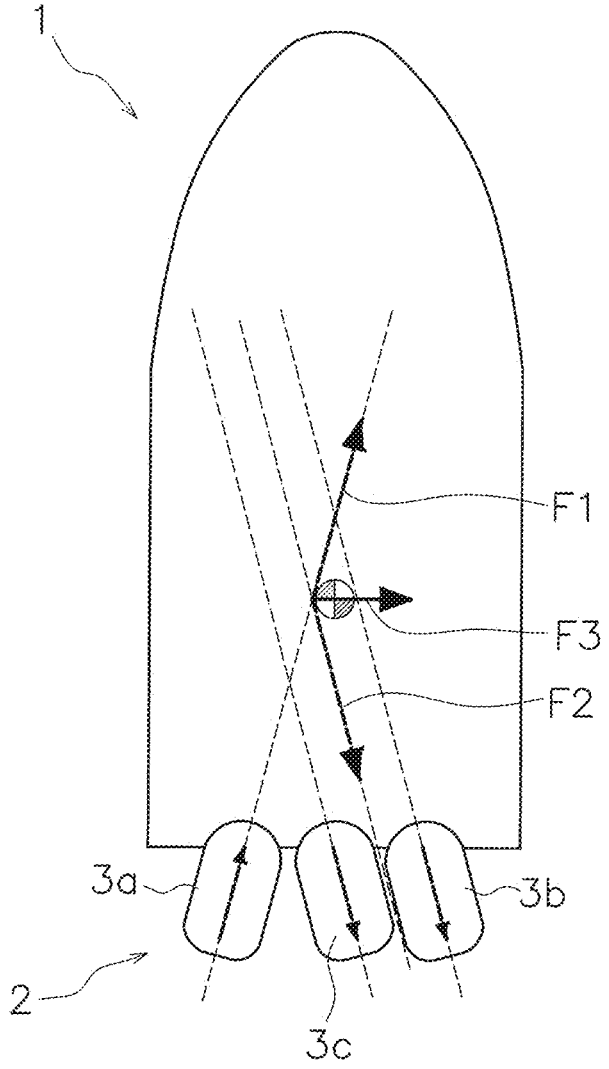
FIG. 4 is a diagram showing propulsive forces in a lateral movement mode.

Specifically, when the tilt direction of the joystick 32 includes a vector in a lateral direction, the controller 33 controls the propulsion devices 3*a* to 3*c* and the steering actuators 26*a* to 26*c* in the lateral movement mode. FIG. 4 is a diagram showing the propulsive forces in the lateral movement mode when the tilt direction of the joystick 32 includes a right vector.

As illustrated in FIG. 4, the controller 33 sets the steering angle of the left propulsion device 3*a* and the steering angle of the right propulsion device 3*b* to be opposite to each other and inclined at a predetermined angle with respect to the longitudinal direction. Further, the controller 33 tilts the central propulsion device 3*c* in the same direction as the left propulsion device 3*a* or the right propulsion device 3*b*. The controller 33 controls the left propulsion device 3*a* and the right propulsion so that the direction F3 of a resultant force of the propulsive forces of the left propulsion device 3*a*, the right propulsion device 3*b*, and the central propulsion device 3*c* corresponds to the tilt direction of the joystick 32.

In FIG. 4, F1 is a forward propulsive force and corresponds to the propulsive force of the left propulsion device 3*a*. F2 is a backward propulsive force and corresponds to a resultant force of the propulsive forces of the central propulsion device 3*c* and the right propulsion device 3*b*. When the tilt direction of the joystick 32 includes a left vector, the controller 33 controls the left propulsion device 3*a*, the right propulsion device 3*b*, and the central propulsion device 3*c* symmetrically with the above.

As illustrated in FIG. 3, the vessel steering system 2 includes a position sensor 38. The position sensor 38 detects the position of the vessel 1 and outputs position data indicative of the position of the vessel 1. The position sensor 38 includes a GNSS (Global Navigation Satellite System) receiver such as a GPS (Global Positioning System). The position sensor 38 outputs a signal indicative of the position of the vessel 1 to the controller 33.

Figure 5:
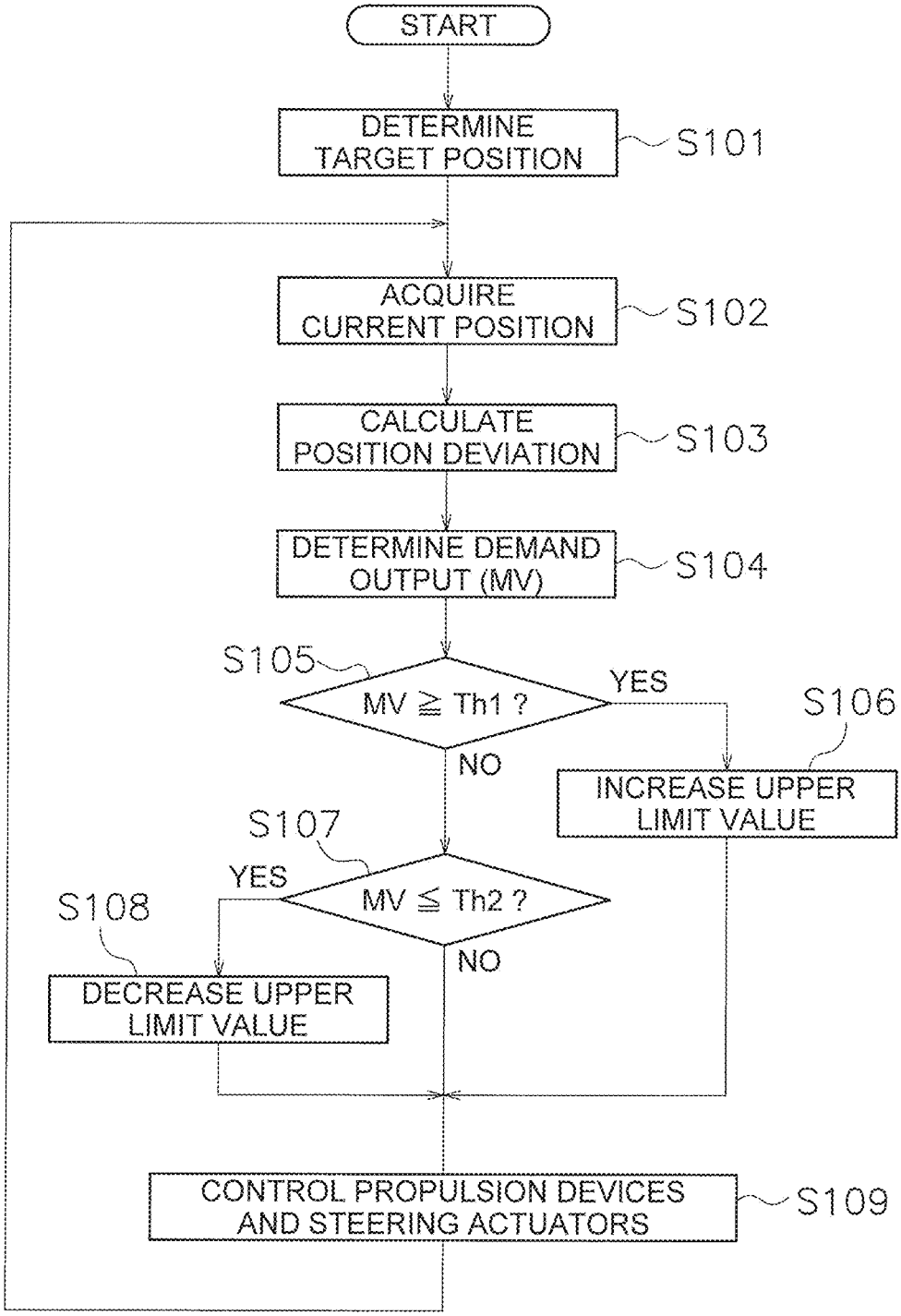
FIG. 5 is a flowchart showing processes in a fixed point holding mode.

The controller 33 controls the propulsion devices 3*a* to 3*c* and the steering actuators 26*a* to 26*c* in the fixed point holding mode. In the fixed point holding mode, the controller 33 holds the position of the vessel 1 at a predetermined target position. The controller 33 executes the fixed point holding mode when receiving an input operation by a user, for example. Alternatively, the controller 33 may automatically execute the fixed point holding mode when a predetermined execution condition is satisfied. FIG. 5 is a flowchart showing processes in the fixed point holding mode executed by the controller 33.

As illustrated in FIG. 5, in step S101, the controller 33 determines the target position of the vessel 1. The controller 33 may determine a position of the vessel 1 when the user performs a start operation of the fixed point holding mode as the target position. Alternatively, the controller 33 may determine a position designated from a map data as the target position.

In step S102, the controller 33 acquires a current position of the vessel 1. The controller 33 acquires the current position of the vessel 1 based on the signal received from the position sensor 38. In step S103, the controller 33 calculates a deviation between the current position of the vessel 1 and the target position.

In step S104, the controller 33 determines a demand output MV. The controller 33 determines the demand output MV of the propulsion devices 3*a* to 3*c* by feedback control so that the deviation approaches 0. The controller 33 determines the demand output MV of the propulsion devices 3*a* to 3*c* by PI control, for example.

The demand output MV of the propulsion devices 3*a* to 3*c* is defined as a predetermined ratio with respect to a predetermined upper limit value. The demand output MV is defined as a ratio from 0% to 100% with respect to the predetermined upper limit value. The controller 33 determines the demand output MV in the range of 0% to 100%. The upper limit value is indicated by the propulsive force of the propulsion devices 3*a* to 3*c*. When starting the vessel steering system 2, the predetermined upper limit value is the initial value F1. Accordingly, when the demand output MV of the propulsion devices 3*a* to 3*c* is 100% at the start of the vessel steering system 2, the controller 33 controls the propulsion devices 3*a* to 3*c* so that the resultant force of the propulsive forces of the propulsion devices 3*a* to 3*c* corresponds to the upper limit value F1.

As illustrated in FIG. 5, in step S105, the controller 33 determines whether the demand output MV is equal to or greater than a first threshold Th1. The first threshold Th1 is larger than 50% and smaller than 100%, for example. The first threshold Th1 is 90%, for example. However, the first threshold Th1 may be a value other than 90%. When the demand output MV is greater than or equal to the first threshold Th1, the process proceeds to step S106.

In step S106, the controller 33 increases the upper limit value. The controller 33 may increase the upper limit value by adding a predetermined value to the previous upper limit value. Alternatively, the controller 33 may increase the upper limit value by multiplying the previous value by a predetermined value greater than 1.

In step S105, when the demand output MV is smaller than the first threshold Th1, the process proceeds to step S107. In step S107, the controller 33 determines whether the demand output MV is equal to or less than a second threshold Th2. The second threshold Th2 is smaller than the first threshold Th1. The second threshold Th2 is, for example, 50%. However, the second threshold Th2 may be a value other than 50%. When the demand output MV is less than or equal to the second threshold Th2, the process proceeds to step S108.

In step S108, the controller 33 decreases the upper limit value. The controller 33 may decrease the upper limit value by subtracting a predetermined value from the previous value of the upper limit value. Alternatively, the controller 33 may decrease the upper limit value by multiplying the previous value by a predetermined value smaller than 1.

Thereafter, in step S109, the controller 33 controls the propulsion devices 3*a* to 3*c* and the steering actuators 26*a* to 26*c*. The controller 33 controls the propulsion devices 3*a* to 3*c* and the steering actuators 26*a* to 26*c* so that the vessel 1 moves toward the target position. Further, the controller 33 controls the propulsion devices 3*a* to 3*c* so that the resultant force of the propulsive forces of the propulsion devices 3*a* to 3*c* has a magnitude corresponding to the demand output MV.

Thereafter, the process returns to step S102, and the processes from step S102 to step S109 are repeated. Accordingly, the target position of the vessel 1 is held.

Figure 6:
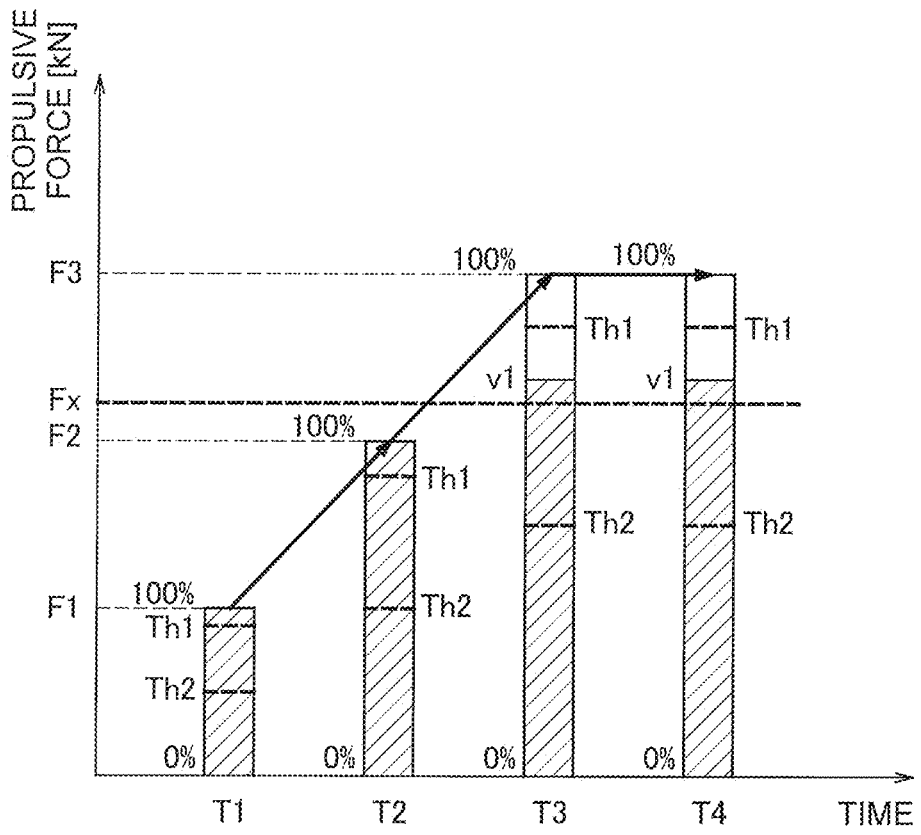
FIG. 6 is a graph showing a change of an upper limit value of the propulsive force in the fixed point holding mode.

FIG. 6 is a graph showing a change in the upper limit value when an initial upper limit value F1 of the propulsive force is too small for an adequate propulsive force Fx to hold the vessel 1 at the target position. In FIG. 6, a hatched portion indicates the demand output MV determined in step S104.

As illustrated in FIG. 6, at time T1, the upper limit value of the propulsive force is F1. The propulsive force F1 is smaller than the appropriate propulsive force Fx. Therefore, the controller 33 determines the demand output MV to be 100% at the time T1. In this case, the demand output MV is greater than or equal to the first threshold Th1. Therefore, the controller 33 increases the upper limit value from F1 to F2.

At time T2, the propulsive force F2 is still small relative to the appropriate propulsive force Fx. Therefore, the controller 33 determines the demand output MV as 100%. In this case, the demand output MV is greater than or equal to the first threshold Th1. Therefore, the controller 33 increases the upper limit value from F2 to F3.

At time T3, the propulsive force F3 is moderately larger than the appropriate propulsive force Fx. The controller 33 determines the demand output MV as v1. v1 is smaller than the first threshold Th1. Further, v1 is larger than the second threshold Th2. Therefore, at time T4, the controller 33 holds the upper limit value at F3 without increasing or decreasing the upper limit value.

Figure 7:
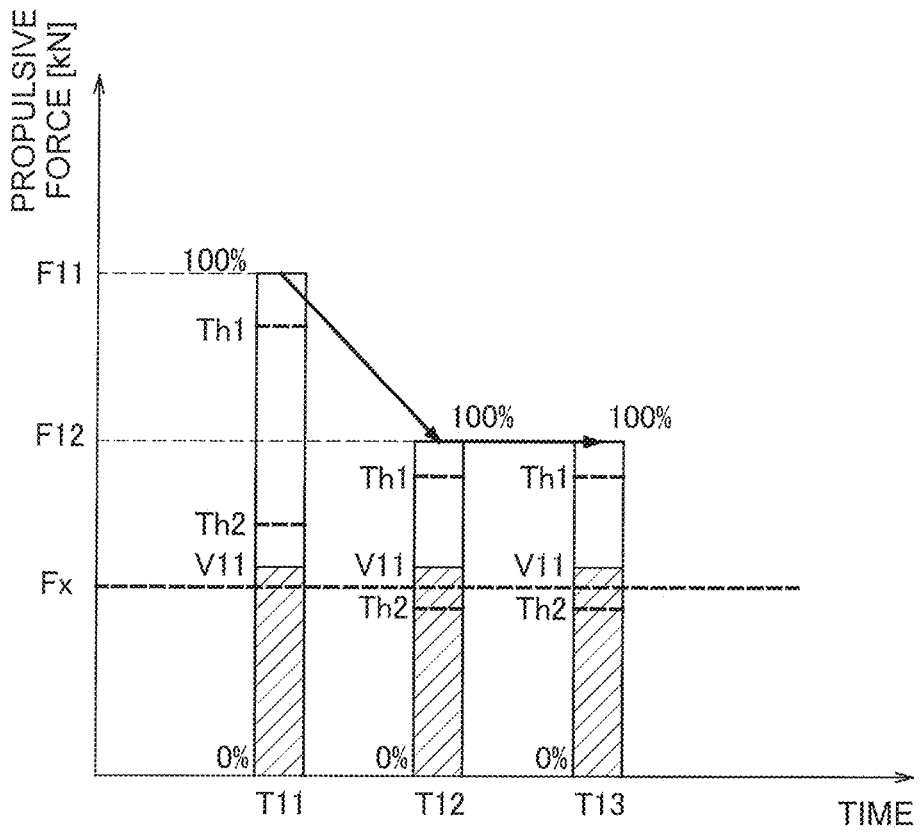
FIG. 7 is a graph showing a change of an upper limit value of the propulsive force in the fixed point holding mode.

FIG. 7 is a graph showing a change in the upper limit value when an initial upper limit value F11 of the propulsive force is too large for an adequate propulsive force Fx to hold the vessel 1 at the target position. As illustrated in FIG. 7, the controller 33 determines the demand output MV to be v11 at time T11. At the time T11, the upper limit value of the propulsive force is F11. The propulsive force F11 is excessively large relative to the appropriate propulsive force Fx. v11 is equal to or less than the second threshold Th2. Therefore, the controller 33 decreases the upper limit value from F11 to F12.

The controller 33 determines the demand output MV to be v11 at time T12. The propulsive force F12 is appropriately larger than the appropriate propulsive force Fx. At the time T12, v11 is greater than the second threshold Th2. Further, v12 is smaller than the first threshold Th1. Therefore, at time T13, the controller 33 holds the upper limit value at F12 without increasing or decreasing the upper limit value.

According to the vessel steering system 2 according to the preferred embodiments described above, the demand output MV of the propulsion devices 3*a* to 3*c* is determined by feedback control according to the deviation between the current position and the target position. When the demand output MV of the propulsion devices 3*a* to 3*c* is equal to or greater than the first threshold Th1, the upper limit value is increased. Therefore, the upper limit value is increased when the upper limit value of the propulsive force corresponding to the value 100% of the demand output MV is smaller than an appropriate value to hold the vessel 1 at the target position. Thereafter, the upper limit value is further increased when the demand output MV of the propulsion devices 3*a* to 3*c* is still equal to or greater than the first threshold Th1. In this way, the increase of the upper limit value is repeated until the demand output MV of the propulsion devices 3*a* to 3*c* approaches the appropriate propulsive force to hold the vessel 1 at the target position. Thus, it is possible to determine an appropriate propulsive force to hold the vessel 1 at the target position.

Further, when the demand output MV of the propulsion devices 3*a* to 3*c* is equal to or less than the second threshold Th2, the upper limit value is decreased. Therefore, when the upper limit value of the propulsive force corresponding to the value 100% of the demand output MV is much larger than an appropriate value to hold the vessel 1 at the target position, the upper limit value is decreased. Thereafter, the upper limit value is further decreased when the demand output MV of the propulsion devices 3*a* to 3*c* is still less than or equal to the second threshold Th2. Thus, it is possible to determine an appropriate propulsive force to hold the vessel 1 at the target position.

As mentioned above, although preferred embodiments of the present invention have been described, the present invention is not limited to the above-described preferred embodiments, and a variety of changes can be made without departing from the gist of the present invention.

The number of propulsion devices is not limited to three, and may be smaller than three or larger than three. The propulsion device is not limited to an outboard motor, and may be another type of propulsion device such as an inboard/outboard motor. The configuration of the propulsion device is not limited to that of the above-described preferred embodiments, and may be changed.

The controller 33 is not limited to a single device, and may include a plurality of controllers. The processes performed in the lateral movement mode described above may be executed by a plurality of controllers. Some of the processes described above may be changed or omitted.

In the lateral movement mode, the central propulsion device 3*c* may not be inclined in the same direction as the left propulsion device 3*a* or the right propulsion device 3*b*. The controller 33 may set the steering angle of the central propulsion device 3*c* to a steering angle different from that of the left propulsion device 3*a* or the right propulsion device 3*b*.

The processes in the fixed point holding mode is not limited to that in the above-described preferred embodiments, and may be changed. For example, the demand output MV may be indicated by the magnitude of the propulsive force instead of a ratio with respect to the upper limit value.

In the above-described preferred embodiments, the controller 33 uses the current position of the vessel 1 as a parameter for feedback control in the fixed point holding mode. However, the controller 33 may use the vessel speed as a parameter for feedback control in the fixed point holding mode. In this case, the controller 33 may determine the demand output MV of the propulsion devices 3*a* to 3*c* by feedback control so that the vessel speed becomes zero. The vessel speed may be calculated from a change in the current position of the vessel 1 detected by the position sensor 38. Alternatively, the vessel speed may be detected by a sensor such as a pitot tube.

Figure 8:
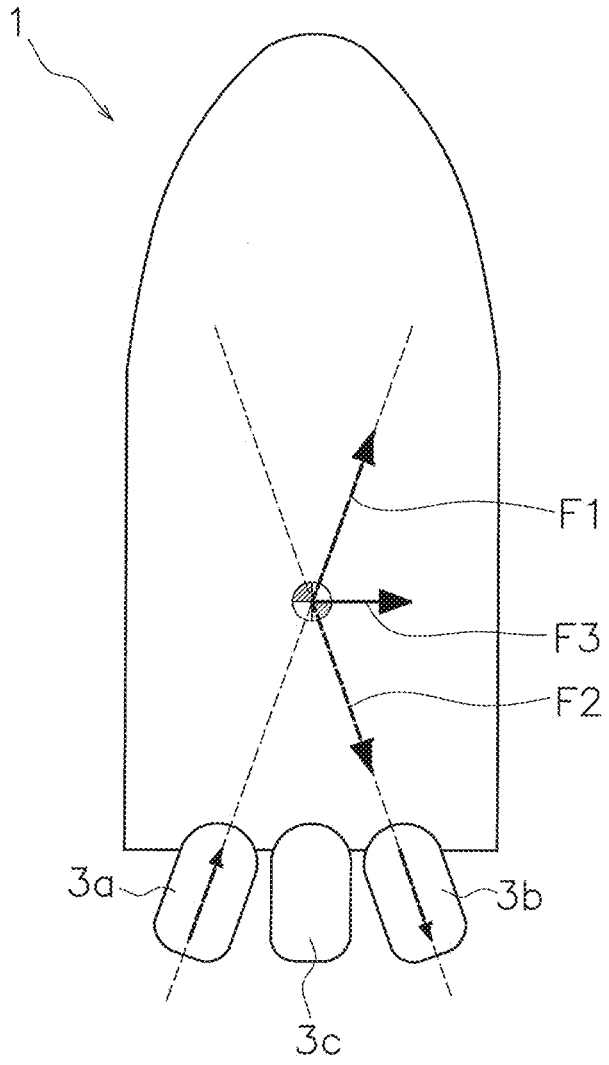
FIG. 8 is a diagram showing a control according to a modified preferred embodiment of the present invention.

In the fixed point holding mode, the controller 33 may execute a control according to the following modification. FIG. 8 is a diagram illustrating a control according to a modified preferred embodiment of the present invention. In the control according to the modified preferred embodiment of the present invention, when the demand output MV is equal to or less than the first threshold, the controller 33 sets the output of the central propulsion device 3*c* to 0, and holds the position of the vessel 1 by the propulsive forces of the left propulsion device 3*a* and the right propulsion device 3*b*. The first threshold is a value smaller than the maximum value of the resultant force F3 of the propulsive forces of the left propulsion device 3*a* and the right propulsion device 3*b*. For example, the first threshold is a value acquired by multiplying the resultant force F3 by a predetermined coefficient smaller than 1. In this case, for example, the central propulsion device 3*c* is maintained in neutral. Thus, the vessel 1 is able to be controlled with a low output. Therefore, the controllability in the fixed point holding mode is improved. Moreover, since the steering of the central propulsion device 3*c* does not occur, the quietness is improved.

When the demand output MV is greater than or equal to the second threshold, as illustrated in FIG. 4, the controller 33 uses the propulsive forces of the left propulsion device 3*a*, the right propulsion device 3*b*, and the central propulsion device 3*c* to hold the position of the vessel 1. The second threshold is smaller than the maximum value of the resultant force F3 of the propulsive forces of the left propulsion device 3*a* and the right propulsion device 3*b*. The second threshold is larger than the first threshold. For example, the second threshold is a value acquired by multiplying the resultant force F3 by a predetermined coefficient smaller than 1. Thus, the propulsive force required to hold the position of the vessel 1 is able to be maintained. In addition, it is possible to prevent frequent delays in the control response due to switching of the driven propulsion device. Thus, the propulsion device is able to be controlled smoothly. Furthermore, it is possible to significantly reduce or prevent the occurrence of a shift shock accompanying switching of the driven propulsion device.

When there are four or more propulsion devices, the same control as the control according to the modified preferred embodiment may be performed. In that case, the controller 33 may control the leftmost propulsion device and the rightmost propulsion device in the same manner as the left and right propulsion devices 3*a* and 3*b*. The controller 33 may control a plurality of propulsion devices between the leftmost propulsion device and the rightmost propulsion device in the same manner as the central propulsion device 3*c* described above.

Figure 9:
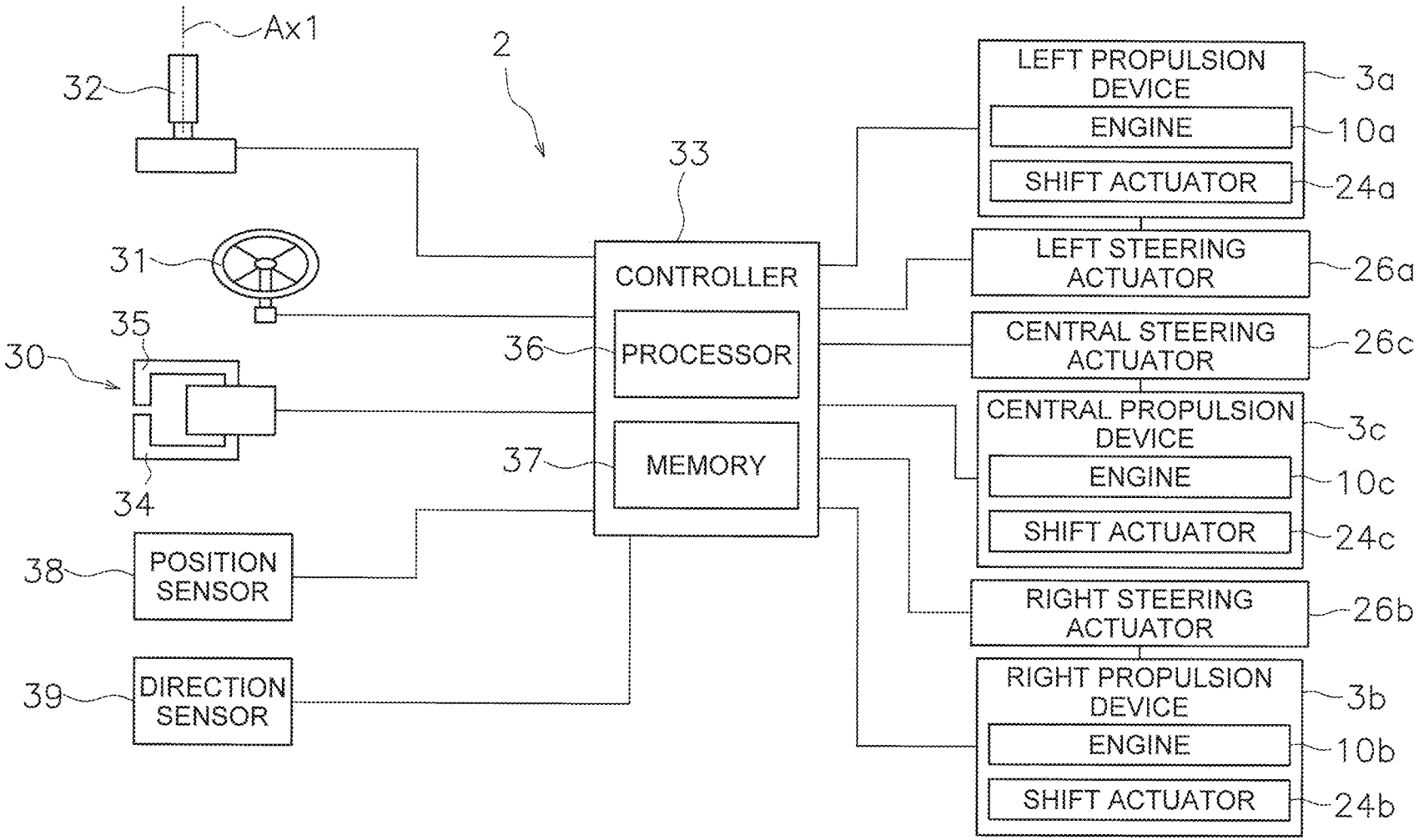
FIG. 9 is a schematic diagram showing a structure of the vessel steering system according to another preferred embodiment of the present invention.

The controller 33 may acquire a first parameter including a position change of the vessel 1 or a vessel speed in the geographic coordinate system. The controller 33 may convert the first parameter into a second parameter including a position change of the vessel 1 with respect to the bow direction of the vessel 1 or a vessel speed. For example, as illustrated in FIG. 9, the vessel steering system 2 may include a direction sensor 39. The direction sensor 39 detects the direction in which the bow of the vessel 1 is facing. The direction sensor 39 may be a magnetic sensor or a gyro, for example. The controller 33 may acquire the first parameter from the position sensor 38. The controller 33 may convert the first parameter into the second parameter according to the direction acquired from the direction sensor 39.

Figure 10:
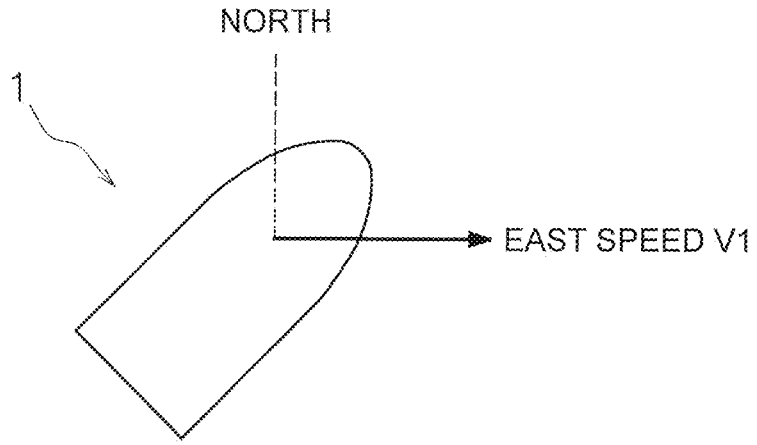
FIG. 10 is a diagram showing an example of a first parameter and a second parameter.
Figure 10:
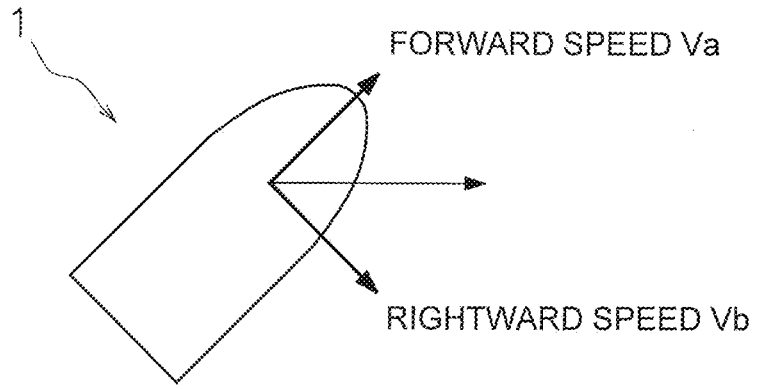

For example, as illustrated in FIG. 10, when the vessel 1 is moving east at a speed V1, the first parameter is an east speed V1. Based on the heading of the bow, the controller 33 converts the east speed V1 into a speed in the longitudinal direction and a speed in the lateral direction of the vessel 1. As illustrated in FIG. 10, the controller 33 converts the east speed V1 into a forward speed Va of the vessel 1 and a rightward speed Vb of the vessel 1. The controller 33 determines a target speed forward of the vessel 1 and a target speed rightward of the vessel 1, and determines a demand output of the propulsion device by feedback control according to a deviation between the target speeds and the second parameter.

The controller 33 may determine the target azimuth and control the propulsion devices by feedback control so that the actual azimuth of the vessel 1 approaches the target azimuth. Further, the controller 33 may selectively execute the feedback control based on the first parameter and the feedback control based on the second parameter in accordance with the deviation between the target azimuth and the actual azimuth (hereinafter referred to as "azimuth deviation"). For example, when the azimuth deviation is smaller than a predetermined threshold, the controller 33 may execute the feedback control based on the first parameter. When the azimuth deviation is equal to or greater than the predetermined threshold, the controller 33 may execute the feedback control based on the second parameter.

According to preferred embodiments of the present invention, it is possible to determine an appropriate propulsive force to hold a vessel at a target position.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel steering system comprising:
a propulsion device;
a controller configured or programmed to:
control the propulsion device in a fixed point holding mode to hold a position of a vessel;
acquire a parameter including a position of the vessel or a vessel speed;
determine a target value for the parameter;
determine a demand output of the propulsion device within a range of a predetermined upper limit value or less by feedback control according to a deviation between the parameter and the target value; and
increase the predetermined upper limit value when the demand output of the propulsion device is equal to or greater than a first threshold defined by a predetermined ratio with respect to the upper limit value.

2. The vessel steering system according to claim 1, wherein the controller is configured or programmed to:
decrease the upper limit value when the demand output of the propulsion device is equal to or less than a second threshold; and
the second threshold is defined by a predetermined ratio with respect to the upper limit value, and the second threshold is less than the first threshold.

3. The vessel steering system according to claim 2, wherein the controller is configured or programmed to hold the upper limit value when the demand output of the propulsion device is within a range between the first threshold and the second threshold.

4. The vessel steering system according to claim 1, wherein the controller is configured or programmed to:
determine the demand output of the propulsion device within a range of 0% to 100%; and
increase the propulsive force of the propulsion device defining 100% of the demand output of the propulsion device when the demand output of the propulsion device is equal to or greater than the first threshold.

5. The vessel steering system according to claim 4, wherein the controller is configured or programmed to decrease the propulsive force defining 100% of the demand output of the propulsion device when the demand output of the propulsion device is equal to or less than the second threshold that is less than the first threshold.

6. The vessel steering system according to claim 1, wherein the propulsion device includes:
a left propulsion device;
a right propulsion device; and
a central propulsion device disposed between the left propulsion device and the right propulsion device;
the controller is configured or programmed to:
in the fixed point holding mode, set an output of the central propulsion device to 0 and hold the position of the vessel by the propulsive forces of the left propulsion device and the right propulsion device when the demand output is equal to or less than the first threshold based on a maximum value of a resultant force of the propulsive forces of the left propulsion device and the right propulsion device.

7. The vessel steering system according to claim 1, wherein the propulsion device includes:
a left propulsion device;
a right propulsion device; and
a central propulsion device disposed between the left propulsion device and the right propulsion device;
the controller is configured or programmed to:
in the fixed point holding mode, hold the position of the vessel by the propulsive forces of the left propulsion device, the right propulsion device, and the central propulsion device when the demand output is equal to or greater than a second threshold based on a maximum value of a resultant force of the propulsive forces of the left propulsion device and the right propulsion device.

8. The vessel steering system according to claim 1, wherein the controller is configured or programmed to:
acquire a first parameter including a position change of the vessel or a vessel speed in a geographic coordinate system;
convert the first parameter into a second parameter including a position change of the vessel or a vessel speed based on a bow direction of the vessel;
determine a target value for the second parameter; and
determine the demand output of the propulsion device by feedback control according to a deviation between the second parameter and the target value.

9. A method performed by a controller to steer a vessel including a propulsion device, the method comprising:
receiving a command signal of a fixed point holding mode to hold a position of the vessel;
acquiring a parameter including the position of the vessel or a vessel speed;
determining a target value for the parameter;
determining a demand output of the propulsion device within a range of a predetermined upper limit value or less by feedback control according to a deviation between the parameter and the target value; and
increasing the upper limit value when the demand output of the propulsion device is equal to or greater than a first threshold defined by a predetermined ratio with respect to the predetermined upper limit value.

10. The method according to claim 9, further comprising:
decreasing the upper limit value when the demand output of the propulsion device is equal to or less than a second threshold; wherein
the second threshold is defined as a predetermined ratio with respect to the predetermined upper limit value, and is smaller than the first threshold.

11. The method according to claim 10, further comprising:
holding the upper limit value when the demand output of the propulsion device is within a range between the first threshold and the second threshold.

12. The method according to claim 9, wherein
the demand output of the propulsion device is in a range of 0% to 100%; and
the increasing the upper limit value includes increasing the propulsive force defining 100% of the demand output of the propulsion device.

13. The method according to claim 10, wherein
the demand output of the propulsion device is in a range of 0% to 100%; and
the decreasing the upper limit value includes decreasing the propulsive force defining 100% of the demand output of the propulsion device.

14. The method according to claim 9, wherein the propulsion device includes:
a left propulsion device;
a right propulsion device; and
a central propulsion device disposed between the left propulsion device and the right propulsion device; and the method further comprises:

in the fixed point holding mode, setting an output of the central propulsion device to 0 and holding the position of the vessel by the propulsive forces of the left propulsion device and the right propulsion device when the demand output is equal to or less than the first threshold based on a maximum value of a resultant force of the propulsive forces of the left propulsion device and the right propulsion device.

15. The method according to claim 9, wherein the propulsion device includes:

a left propulsion device;

a right propulsion device;

a central propulsion device disposed between the left propulsion device and the right propulsion device; and the method further comprises:

in the fixed point holding mode, holding the position of the vessel by the propulsive forces of the left propulsion device, the right propulsion device, and the central propulsion device when the demand output is equal to or greater than a second threshold based on a maximum value of a resultant force of the propulsive forces of the left propulsion device and the right propulsion device.

16. The method according to claim 9, wherein the acquiring the parameter includes:

acquiring a first parameter including a position change of the vessel or a vessel speed in a geographic coordinate system; and converting the first parameter into a second parameter including a position change of the vessel or a vessel speed based on a bow direction of the vessel; and the determining the demand output of the propulsion device includes determining the demand output of the propulsion devices by feedback control according to a deviation between the second parameter and the target value.

* * * * *